United States Patent [19]

Rexroad et al.

[11] 4,081,642

[45] Mar. 28, 1978

[54] SWITCH CONSTRUCTION AND OPERATING MECHANISM THEREFOR

[75] Inventors: James O. Rexroad, Beaver; Louis N. Ricci, Beaver Falls, both of Pa.

[73] Assignee: Westinghouse Electric Corporation, Pittsburgh, Pa.

[21] Appl. No.: 633,190

[22] Filed: Nov. 19, 1975

Related U.S. Application Data

[63] Continuation of Ser. No. 485,677, Jul. 3, 1974, abandoned, and Ser. No. 316,637, Dec. 19, 1972, abandoned, and Ser. No. 130,376, Apr. 1, 1971, abandoned.

[51] Int. Cl.[2] ..... H01H 3/00

[52] U.S. Cl. ..... 200/153 G; 200/153 H; 335/166; 335/188

[58] Field of Search ..... 200/153 G, 153 H, 330; 335/166, 188, 37; 337/59

[56] References Cited

U.S. PATENT DOCUMENTS

| | | | |
|---|---|---|---|
| 1,786,796 | 12/1930 | Von Hoorn | 337/59 |
| 1,901,692 | 3/1933 | Baxter | 337/59 |
| 2,043,306 | 6/1936 | Sandin | 335/37 |
| 2,083,304 | 6/1937 | Lindstrom | 335/188 |
| 2,083,305 | 6/1937 | Lingal | 335/188 |
| 2,830,154 | 4/1958 | Hermann et al. | 200/330 |
| 3,158,716 | 11/1964 | Koval | 200/153 G |
| 3,185,791 | 5/1965 | Cain | 200/153 H |
| 3,263,051 | 7/1966 | Gauthier et al. | 200/153 G |
| 3,562,733 | 2/1971 | Murphy et al. | 200/153 H |
| 3,605,051 | 9/1971 | Casey | 335/166 |

*Primary Examiner*—Robert S. Macon
*Attorney, Agent, or Firm*—W. R. Crout

[57] ABSTRACT

An improved switch construction is provided having an overcenter-toggle mechanism for effecting the actuation of the one or more movable contacts of the switch. A pivotally-mounted operating lever carries one end of a toggle-tension spring, the other end of which is pivotally connected to the knee-joint pivot of a pair of pivotally-connected toggle links. The line of action of the force of the toggle-tension spring is such as to effect a straightening, or a collapsing of the pivotally-connected toggle-links, to thereby effect, respectively, a closure of the switch contacts, or an opening operation thereof.

Preferably, a releasable rotatable support, or trigger is provided for the pivotal connection of one of the toggle links, so that a remote tripping operation is possible by an unlatching of the releasable support, which normally provides a stationary pivot for the toggle linkage of the mechanism.

The construction is such that should welding occur at the contacts, the rotatable operating arm will indicate a correct position of the contacts, regardless of the effort manually made to provide a different indication of the handle.

3 Claims, 21 Drawing Figures

SWITCH CONSTRUCTION AND OPERATING MECHANISM THEREFOR

CROSS-REFERENCES TO RELATED APPLICATIONS

This is a Continuation of application Ser. Nos. 485,677 filed July 3, 1974; 316,637 filed Dec. 19, 1972; and 130,376 filed Apr. 1, 1971, all abandoned.

A related patent application filed Apr. 19, 1971. Ser. No. 135,107, now U.S. Pat. No. 3,749,867 issued July 31, 1973 to James O. Rexroad and assigned to the assignee of the instant application, described claims as improved arc-chute structure which is particularly adapted for the contact structure of the switch construction described in the instant patent application.

BACKGROUND OF THE INVENTION

The present invention is particularly concerned with panelboard switches adapted, for example, for 250 D.C. and 600-volt A.C. application. Main switches and branch switches may be used together, the main switches, of course, carrying and controlling a greater load current. The particular switch application, with which the present invention is concerned, is adapted for 800 or 1200-ampere current ratings at a voltage, for example, of 600 volts A.C.

It is desirable, as well known by those skilled in the art, to provide switch constructions, which may be snap-opened and snap-closed to prevent contact erosion. It is, additionally, desirable to provide all of the safety features, which can be incorporated into the switch construction. Thus, if the separable contacts have been welded closed, and the mechanism has insufficient capacity, or capability to effect their release, and to open them, it is desirable to have a correct and proper indication of the actual state of affairs, namely to have the externally-disposed operating handle indicate that the switch is "closed," even though the operator is manually attempting to move the switch handle mechanism to the "open" position.

Additionally, it is desirable, in certain instances, to provide for a remote electrical tripping of the switch. Thus, where the maintenance personnel are situated at a remote location, and for some reason desire to effect remote electrical tripping of the switch, it is desirable to provide for this remote electrical tripping of the switch, without the necessity of actually walking over to the switch and manually operating the switch handle.

SUMMARY OF THE INVENTION

According to a preferred embodiment of the present invention, there is provided an improved switch construction having a toggle-type operating mechanism for the movable contacts. The overcenter toggle mechanism of the instant application includes a pair of toggle links, which are pivotally connected together at a pivotal kneejoint, and an operating lever pivotally supported on a fixed pivot, and carrying one end of a toggle-tension spring. The other end of the spring is connected to the knee-joint of the toggle linkage. Thus, rotation of the said operating lever will carry the line of force of the toggle-tension spring to an overcenter position to thereby effect snap-opening and snap-closing of the movable contacts of the switch.

Additionally, the preferred embodiment of the present invention provides a rotatable pivot support, or trigger, which carries a releasable pivot for the toggle linkage. Normally, the rotatable pivot support, or trigger is latched in a fixed position, and provides, in this normal operation, a fixed pivot support for the toggle linkage. At times, such as during remote electrical tripping, it is possible to effect a release of the rotatable pivot support, to thereby move the releasable pivot, and thereby effect collapse of the toggle linkage to result in a consequent opening of the switch contacts.

Upon the remote electrical tripping operation of the switch contacts, it is necessary to reset the mechanism, and in the improved switch mechanism of the instant application, this is accomplished by moving the manually-operable switch handle to the fully-open position. This will reset the toggle mechanism, and a subsequent moving of the said operating handle to the "closed" position will again effect reclosure of the switch contacts.

Accordingly, it is a general object of the present invention to provide an improved switch construction having a novel operating mechanism, which will effect a quick-opening and a quick-closing of the separable switch contacts.

Still a further object of the present invention is the provision of an improved toggle-operating linkage for a switch, in which the pivotal support for the toggle linkage is held in a releasably-fixed position.

Another object of the present invention is the provision of an improved toggle-operating linkage for a switch, in which the toggle linkage will indicate the correct position of the switch contacts, even should they become welded closed.

Another object of the present invention is the provision of an improved toggle-operating linkage for a switch, in which the toggle springs are situated at a location remote from the energized portions of the switch, and also away from the handle-operating linkage.

Another object of the present invention is the provision of an improved toggle-operating linkage for a switch, in which a releasable pivot-support is provided for one of the pivotal connections of the toggle linkage, and said pivotal support has a resetting portion, which is engaged by the operating lever, which carries one end of the toggle-tension spring.

Still a further object of the present invention is the provision of an improved overcenter-type toggle linkage for a switch, in which toggle-tension springs are employed to effect straightening and collapsing of the toggle links, the toggle-tension springs being carried by one end of a rotatable operating arms, the other end of which is actuated by the operating handle of the mechanism of the switch.

Still a further object of the present invention is the provision of an improved toggle-operating linkage for a switch, in which an electrically-actuated rotatable releasing lever is provided, which normally latches a portion of a rotatable toggle pivot support, the latter normally providing a fixed pivot location for the pivotally connected toggle links.

Still a further object of the present invention is the provision of an improved switch construction in which the vertical height or depth of the switch enclosure is maintained at a minimum by a novel relocation and arrangement of the several component parts of the toggle-operating linkage.

Another object of the present invention is the provision of an improved switch construction, in which a minimum number of mechanism parts are employed, and many of the component parts of the mechanism which are utilized preferably have two or more functions.

Another object of the present invention is the provision of an improved switch mechanism in which the heighth between the switch base-plate and the cover of the switch is a minimum, and a novel operating linkage, operatively effected by the handle on the cover, effects overcenter opening and closing movement of the toggle mechanism for the switch.

Another object of the present invention is the provision of an improved toggle-operating linkage for a switch, in which a plurality of toggle-tension springs are provided, and effect a balancing of forces on the component parts of the toggle linkage to symmetrically balance the opening and closing forces on the several component parts of the mechanism.

Another object of the present invention is the provision of an improved overcenter-type of toggle linkage for a switch, in which a spaced pair of side-frame wall members pivotally supports angular-arms on a fixed pivot, in which one end of said angular arms carries the toggle spring, and the other end of said angular arms supports a rod, which is engageable by a sliding operating member on the inner side of the door or cover of the switch housing or box.

Another object of the present invention is the provision of an improved overcenter-type of toggle linkage for a switch, in which a rotatable releasable toggle pivot support is provided for one end of the toggle linkage, and a portion of said rotatable pivotal support serves as an overcenter stop for the straightened position of the toggle linkage in the fully closed position of the switch contacts.

Further objects and advantages will readily become apparent upon reading the following specification taken in conjunction with the drawings.

DESCRIPTION OF THE PREFERRED EMBODIMENTS

Figure 1:
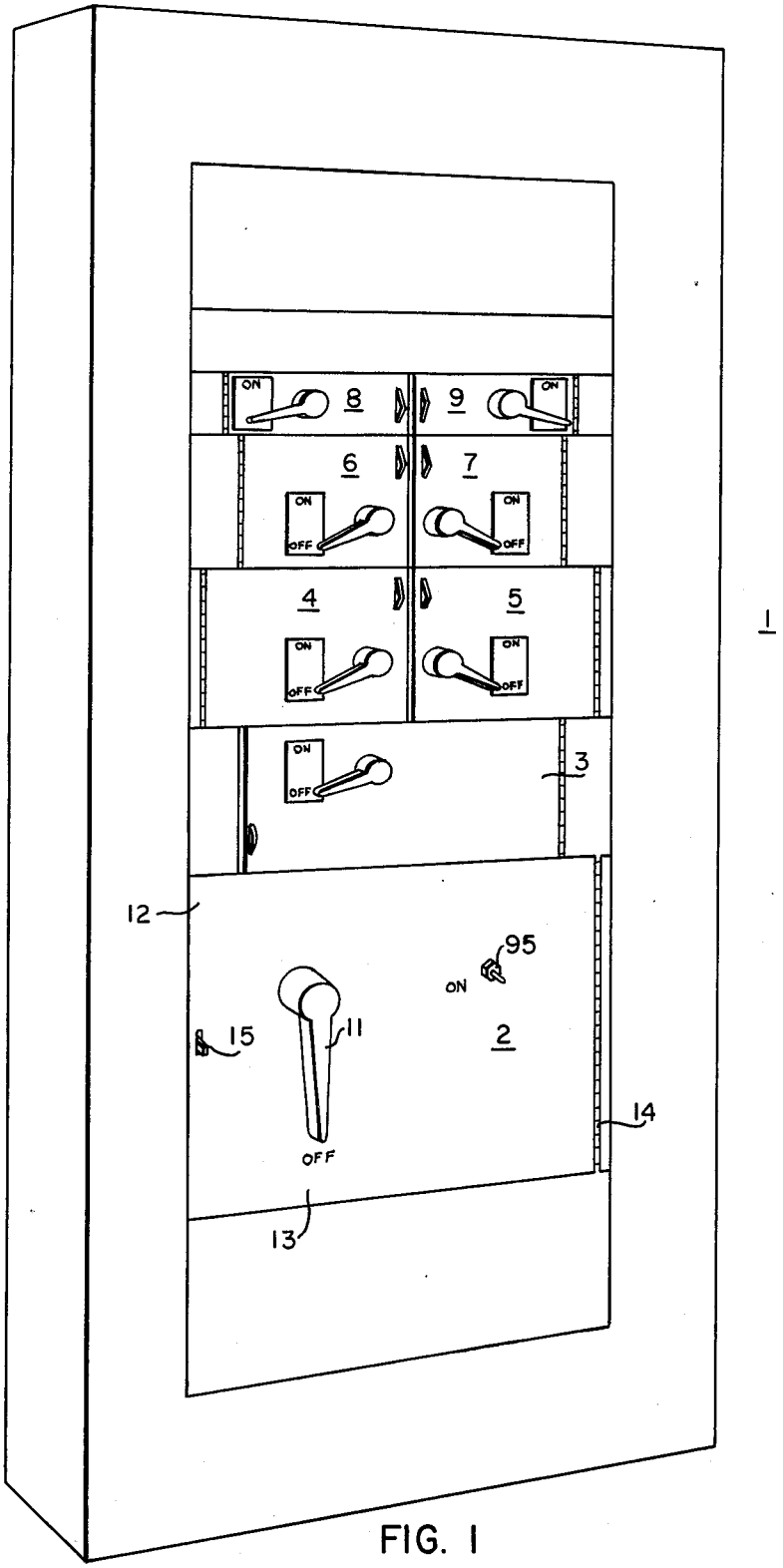
FIG. 1 is a perspective front elevational view of panelboard equipment incorporating the improved switch construction of the present invention, and showing, additionally, several branch feeder switches controlled by feeding off of the main switch of the present invention, the manually operated switch handles being indicated in the "off" position.

Referring to the drawings, and more particularly to FIG. 1 thereof, the reference numeral 1 generally designates panelboard equipment comprising, for example, a main-line switch, generally designated by the reference numeral 2, and controlling a number of branch feeder switches, designated by the reference numerals 3–9. The branch feeder switches, designated by the reference numerals 3–9, are not a part of the present invention, but may be referred to in U.S. Pat. No. 3,525,835, issued Aug. 25, 1970, to Alexander R. Norden, and U.S.

Patent application filed Dec. 12, 1969, Ser. No. 889,804 now U.S. Pat. No. 3,636,291, issued Jan. 18, 1972 to Alexander R. Norden, and also in the U.S. patent application filed Dec. 12, 1969, Ser. No. 889,803, now U.S. Pat. No. 3,632,917, issued Jan. 4, 1972 to Alexander R. Norden, all of the forgoing patents and applications being assigned to the assignee of the instant application.

The bus connections between the several switches are not illustrated in FIG. 1, but it may be assumed that the line-bus connections are controlled by the lower-disposed main panelboard switch 2, which, through feeder-bus connections, are fed to the other branch switches 3–9, which may control various sub-branch circuits.

The improved switch construction 10 of the present invention is embodied in the main panelboard switch 2. FIGS. 2–6 illustrate, in detail, the construction and operation of the improved switch construction 10 of the present invention.

Referring again to FIG. 1 of the drawings, it will be observed that there is provided an external operating handle 11, which may be grasped by a station attendant, and physically rotated to the "ON" and "OFF" positions, as will be apparent from FIG. 1. The switch box enclosure 12 has a cover 13, which is hinged, as at 14, and may be opened or closed, a hasp 15 being provided. The cover 13 may, of course, be padlocked in the "open" or "closed" positions.

Figure 4:
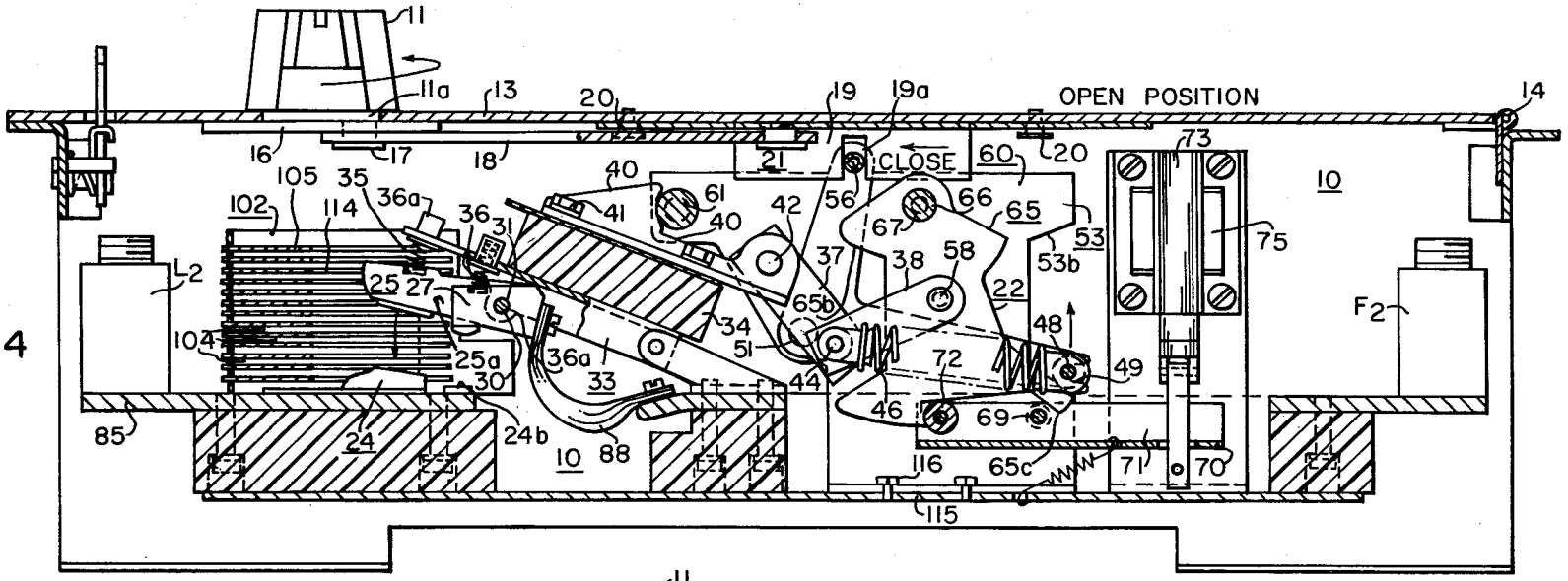
FIG. 4 is a view similar to that of FIG. 3, but illustrating the position of the several contact parts, and also the mechanism parts in the fully open-circuit position.

The rotation of the manually-operable handle 11 effects, through a shank portion 11a, the rotation of a rotatable plate 16 (FIG. 4), which has an offcenter pivotal connection 17 to a link 18, which operates a reciprocally operable slide, designated by the reference numeral 19. The slide 19 is captive within four guides 20, as shown in FIG. 4, and may be reciprocally operated to effect the respective opening and closing operations of the switch mechanism 22.

As illustrated in FIGS. 2–6 of the drawings, it will be apparent that an overcenter-type toggle mechanism 22 is provided to effect the opening and closing movements of the switch contacts 24, 25. In more detail, a main arcing contact **25*c* is associated with two pairs of main movable contacts 27, 28, each set of main contacts 27 or 28 comprising two finger contacts 27*a* or 28*a*. All of the contacts have lateral holes 30 (FIG. 4) drilled therethrough, through the lateral sides thereof, which accommodate a pivot rod 31, which is journaled in the downwardly extending flange portions 33*a* of a contact holder 33, which is affixed to an insulating tie-bar 34, which extends laterally across the three poles A, B and C of the switch 10, as illustrated in more detail in FIG. 2** of the drawings.

Figure 2:
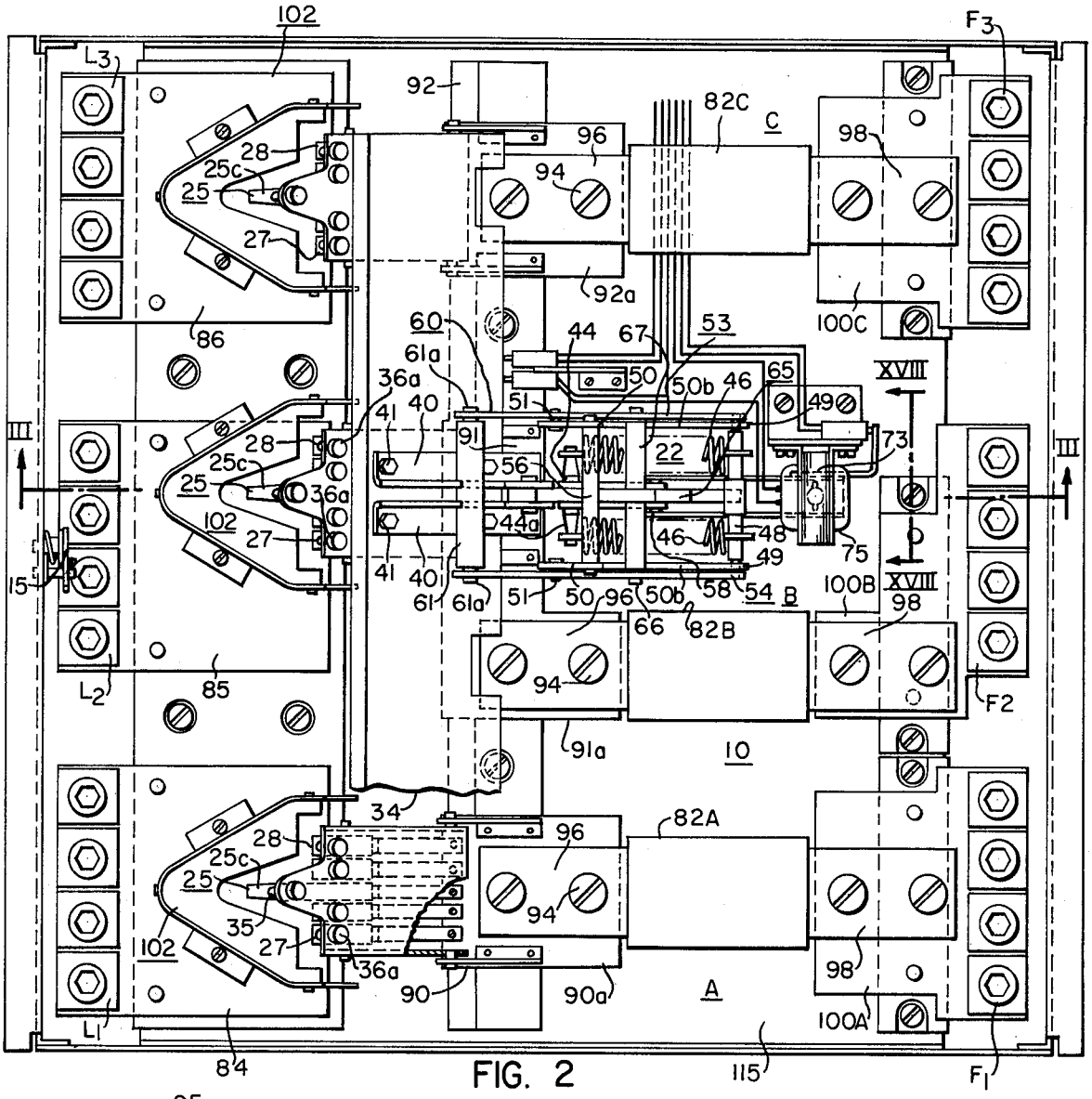
FIG. 2 is an enlarged view looking into the interior of the switch box, with the cover open, and viewing the tops of the three pole-units, and showing a top plan view of the toggle-operating mechanism for actuating the switch, the contacts and mechansim being illustrated in the fully open-circuit position.
Figure 18:
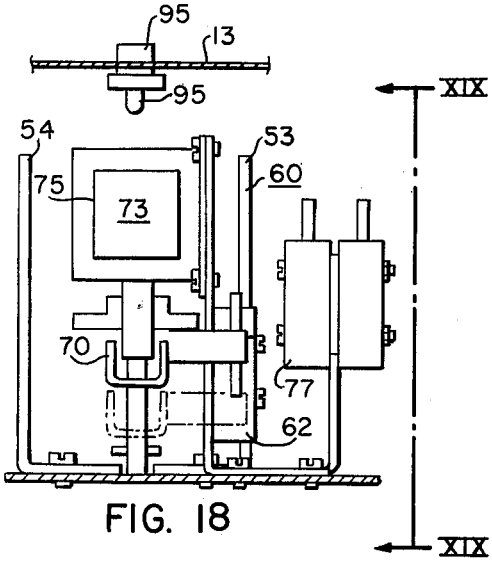
FIG. 18 is a fragmentary view taken substantially along the line XVIII—XVIII of FIG. 2 illustrating the solenoid trip operator and the cutout switch therefor.
Figure 3:
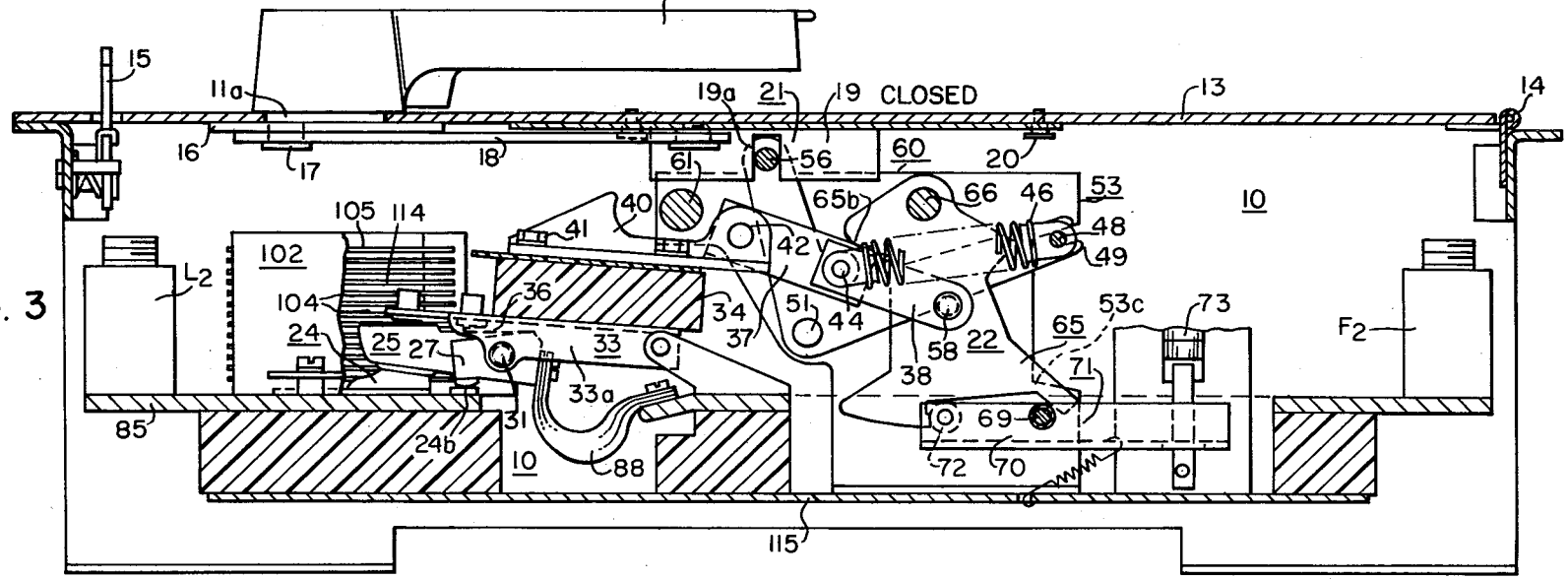
FIG. 3 is a longitudinal vertical sectional view taken substantially along the line III—III of FIG. 2, the switch contacts being illustrated in the "closed" circuit position, and the manually operable switch handle being shown in the closed position.

Thus, with reference to FIG. 2, it will be observed that the main arcing movable contact **25*c* of each pole-unit is spring-biased in a counterclockwise direction about its pivot rod 31, so that when the switch 10 is closed, as illustrated in FIG. 3, the contact-compression spring 35, individual to each contact finger, is compressed. Also, the main contact fingers 27, 28 have their own individual compression springs 36, the upper ends of which seat within cup-shaped spring holders 36*a* affixed to the movable contact support 33**.

Briefly, the overcenter-type toggle mechanism 22 comprises a pair of pivotally-connected toggle links 37, 38, which, in fact, comprise pairs of links **37*a*, 38*a*. FIGS. 3–6 show only a single toggle link 37 or 38, but, in fact, there are two adjoining links 37*a* or 38*a* for each toggle-leg 37 or 38** respectively.

Figure 14:
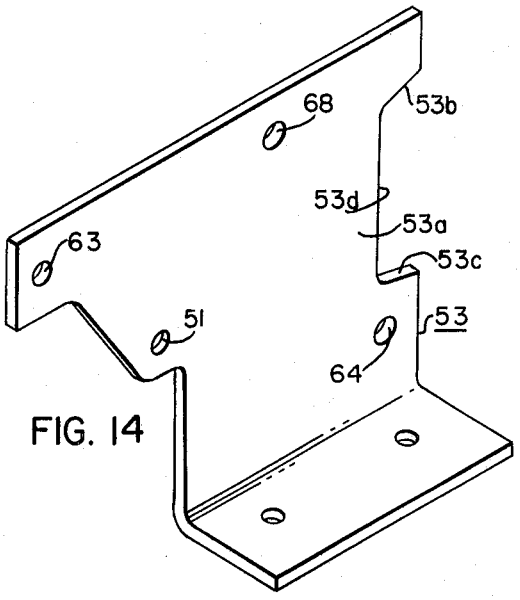
FIG. 14 illustrates one of the two side-frame members for the switch toggle mechanism.
Figure 15:
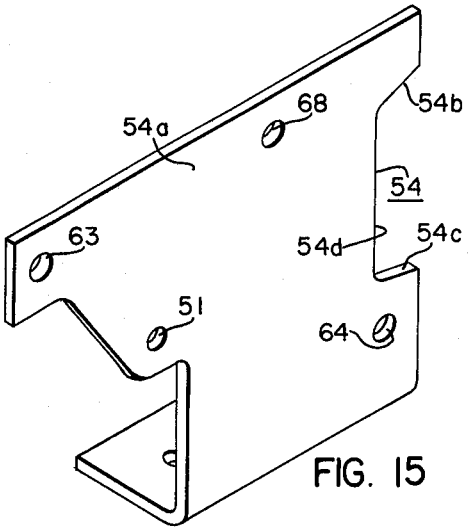
FIG. 15 is a perspective view of the other side-frame member of the switch toggle mechanism.
Figure 17:
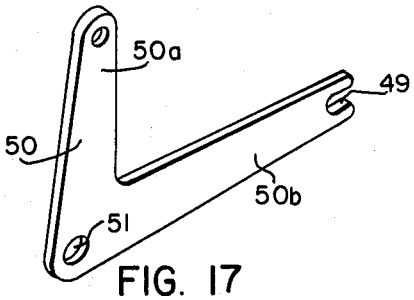
FIG. 17 is a perspective view of one of the pivotally-mounted operating arms, which carry the toggle-tension springs over-center during operation of the switch mechanism.

As shown more clearly in FIG. 4 of the drawings, the toggle-leg 37, comprising the two links **37*a*, is pivotally connected to a pair of spaced operating brackets 40, which are affixed by mounting screws 41 to the insulating tie-bar 34. A pivot pin 42 extends through the rear portions of the operating brackets 40, and connect to the left-hand ends of the toggle leg 37. The two toggle links, or legs 37, 38 are pivotally connected together to a knee-pin 44, which additionally serves as a spring support for one end of each of two toggle-tension springs, designated by the reference numeral 46. The other ends of the two toggle-tension springs 46 are connected to a rod 48, which bears within slots 49 provided in the ends of one leg 50*b* of an angularly shaped operating lever 50 (FIG. 17), which is pivotally supported on a stationary pivot 51. The stationary pivot 51, in fact, comprises a rivet, which extends through the side wall 53*a* of a side-frame support 53, which is illustrated more clearly in FIG. 14 of the drawings. The angularly shaped operating lever 50 is illustrated in perspective in FIG. 17 of the drawings. The companion side-frame support 54 is illustrated in FIG. 15**.

From the foregoing discussion, it will be apparent that rotation of the operating handle 11 will, through the linkage 16–18, effect right-ward opening motion of the slide 19, which through the interposition of the side slots **19*a*, will carry the actuating rod 56 toward the right, as viewed in FIG. 3, thereby carrying the angularly shaped rotatable operating arms 50 and the right-hand ends of the toggle-tension springs 46 downwardly to the position illustrated in FIG. 4. The line of action of the force, exerted by the two toggle-tension springs 46, moves below the toggle pivot 58, and thereby effects collapsing of the toggle-legs 37, 38 to the position illustrated in FIG. 4, thus opening the switch contacts 24, 25**.

Similarly, to effect closing operation of the switch 10, rotation of the operating handle 11 will move the actuating slide 19 toward the left, carrying the upper ends **50*a* of the angularly-shaped arms 50 toward the left, and also moving the line of force of the toggle springs 46 upwardly over the toggle pivot 58 to effect a straightening of the toggle legs 37, 38, as illustrated in FIG. 3, thereby closing the switch contacts 24, 25**.

Figure 5:
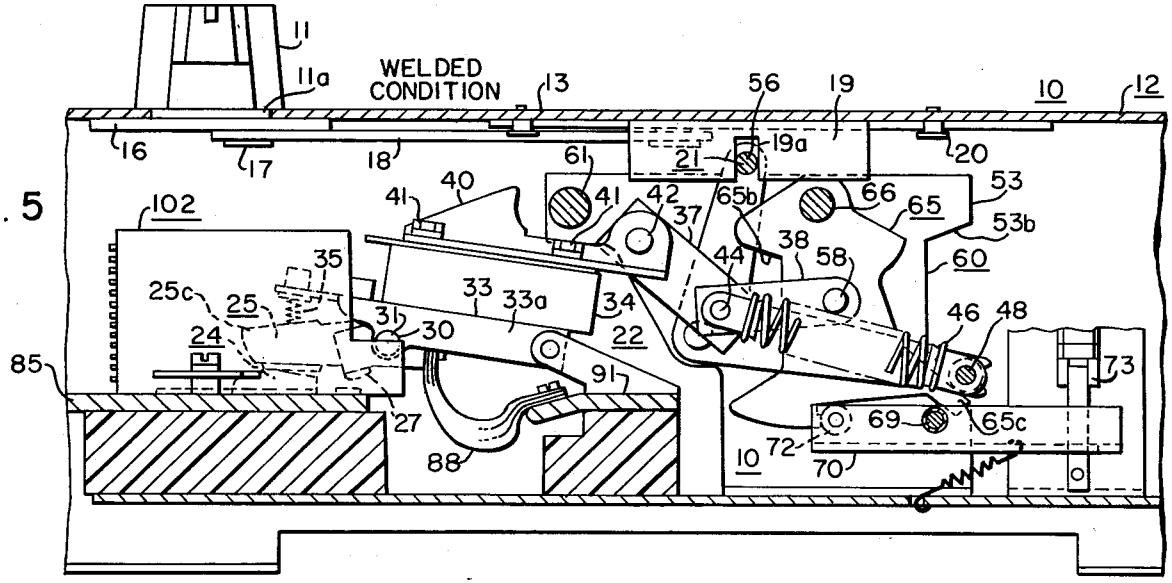
FIG. 5 is a view similar to that of FIGS. 3 and 4, but illustrating a welding condition occuring at the contacts, and showing a handle location, at which the operator is tending to force the contacts open. The view also indicates the situation during an intermediate time of a normal contact-opening operation.
Figure 13:
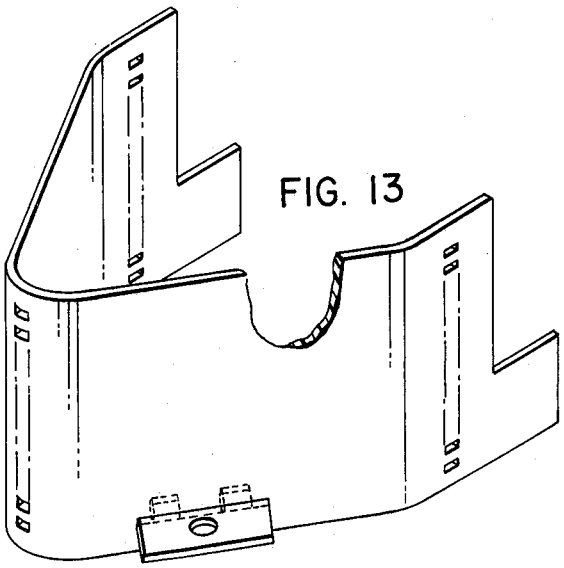
FIG. 13 illustrates, in perspective, the fiber insulating enclosure for positively positioning the several metallic arc plates of the arc-chute structure for the switch contacts.

FIG. 5 illustrates the situation, in which the switch contacts 24, 25 are closed, and the operator desires to effect the opening thereof. The figure illustrates the line of action of the toggle springs 46 as passing below the toggle pivot 58, thereby effecting a partial breaking of the toggle legs 37, 38, and a beginning of the opening operation of the movable switch contacts 24, 25. Additionally, FIG. 5 illustrates the situation involved, where the switch contacts 24, 25 are welded in the closed position, and the mechanism 22 is insufficient in strength to effect a breaking of their welded condition. Even though the operator, through the handle mechansim 11, carries the line of action of the toggle springs 46 downwardly below the toggle-pivot point 58, nevertheless, upon a release of the handle 11 (not shown), the welded condition at the contacts will move the toggle springs 46 above the pivot 58, and indicate, through the slide 19 and the externally exposed handle 11, the correct situation of the contacts 24, 25, namely that they are still closed.

As set forth hereinbefore, if the switch contacts 24, 25 weld, so that they will not break open, their position, with the handle 11 moved to the "off" position, will be near the position shown in FIG. 5, and will upon release by the operator of the handle 11, the handle 11 will be spring biased to its "closed" position thereby indicating the closed welded position of the switch 10.

Figure 6:
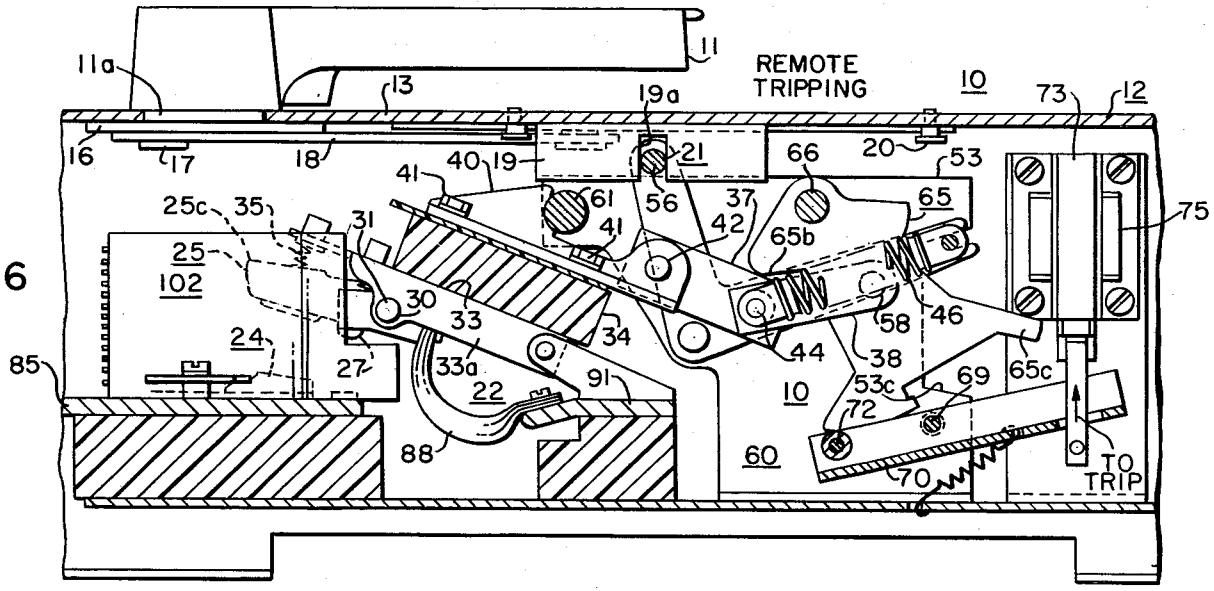
FIG. 6 is a view similar to FIGS. 3–5, but illustrating the remote electrical tripping of the switch by an energization of the solenoid-tripping unit, illustrating a rotation of the rotatable pivotal toggle support of the mechanism.

FIG. 2 illustrates, in more detail, the structural frame support 60 for the toggle-type operating mechanism 22 for the switch 10. It will be observed that there are provided two of the side-frame support plates 53 and 54, which individually are illustrated in FIGS. 14 and 15 of the drawings. A stop pin 61 has reduced end portions 61*a*, which are passed through apertures 63 provided in the side-frame supports 53, 54. This pin 61 serves as a stop for the fully open circuit position of the switch contacts 24, 25, as illustrated in FIGS. 4 and 6 of the drawings.

Figure 16:
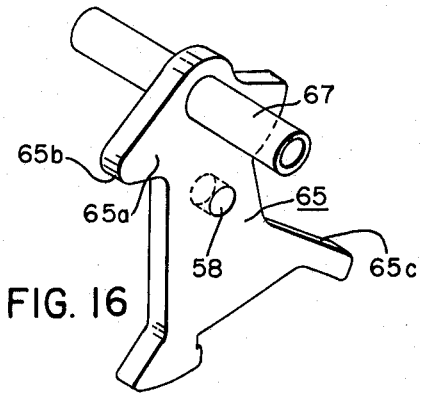
FIG. 16 is a perspective view of the rotatable releasable toggle pivot support, or trigger, for the improved toggle linkage of the switch mechanism.

A rotatable releasable toggle pivot support, or trigger 65 is provided, and is illustrated more clearly in FIG. 16 of the drawings. A rod 66 passes through the tubular sleeve 67, which is affixed to the central main body portion 65*a* of the rotatable toggle pivot support, or trigger 65. The pivot rod 66 passes through suitably provided apertures 68 in the side walls 53*a*, 54*a* of the side-frame supports 53, 54, as illustrated in FIGS. 14 and 15. It will be observed in FIG. 2 that the knee-pin 44 of the toggle linkage 39 has extended portions 44*a*, which serve as the left-hand spring-supports for the two toggle-tension springs 46. Again, FIG. 2 illustrates this more clearly.

In the closed position of the switch contacts 24, 25, wherein the toggle legs 37, 38 are straightened, it will be observed that a portion 65*b* of the body portion of the rotatable toggle support 65 serves as an overcenter stop. This position is illustrated more clearly in FIG. 3 of the drawings. Additionally, another portion 65*c* of the rotatable toggle support 65 serves a resetting function. Thus, for remote electrical tripping, an electrically actuated tripping lever 70 is provided, of channel-shaped configuration, having a roller 72 passing through one end thereof. The tripping lever 70 is pivotally mounted on a rod 69 journaled in apertures 64 of the frame 60. This roller 72 normally maintains the toggle support 65 in a fixed latched position as shown in FIG. 4. Following energization of the solenoid 73, the latching lever 70 is released to thereby permit the toggle springs 46 to effect a consequent counterclockwise rotation of the toggle support 65 to the position illustrated in FIG. 6. In this position, the switch contacts 24, 25 are, of course, open. To effect a resetting and a subsequent closing operation of the switch contacts 24, 25, the operating handle 11 is moved toward a fully-open position from FIG. 6 to that of FIG. 4. This forcibly causes interengagement between the spring rod 48, carrying the right-hand ends of the toggle-tension springs 46, against the resetting portion 65*c* of the body portion of the rotatable toggle-pivot 65, and carries the rotatable toggle-pivot 58 clockwise about its fixed pivot point 66, as shown in FIG. 6, to its reset position, as illustrated in FIGS. 3, 4 and 5 of the drawings.

Following the resetting of the rotatable toggle-pivot 58, the operator may, at this time, move the operating handle 11 toward the closed-switch position, which, as previously described, carries the line of action of the toggle springs 46 upwardly across the toggle-pivot point 58, as illustrated in FIG. 3, thereby closing the switch contacts 24, 25.

Figure 20:
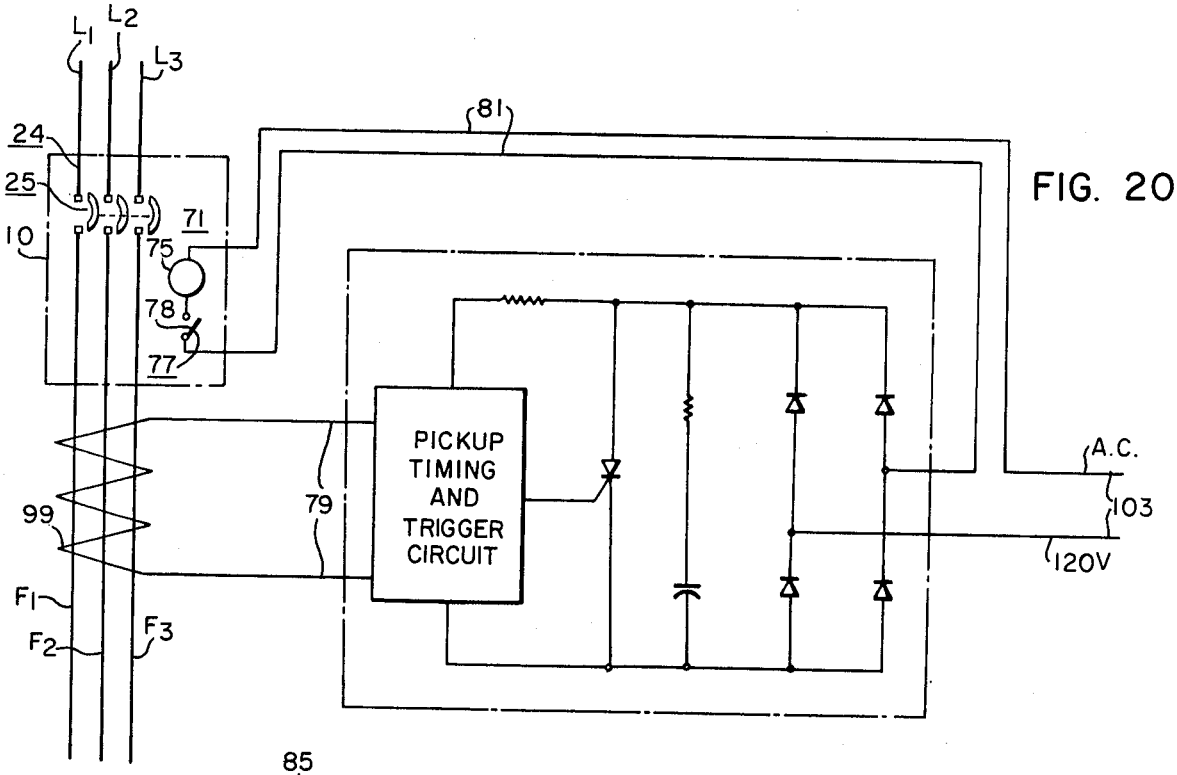
FIG. 20 is a diagram indicating the shunt trip of the switch on low-level ground faults, and also indicating the general circuit for remote tripping of the switch; and, FIG. 21 is an enlarged top plan view of the arc-chute structure of FIG. 7 illustrating the interrelationship of the contacts with the spaced metallic plates of the arc-chute, showing the close proximity of plate material to the main separable contacts.
Figure 21:
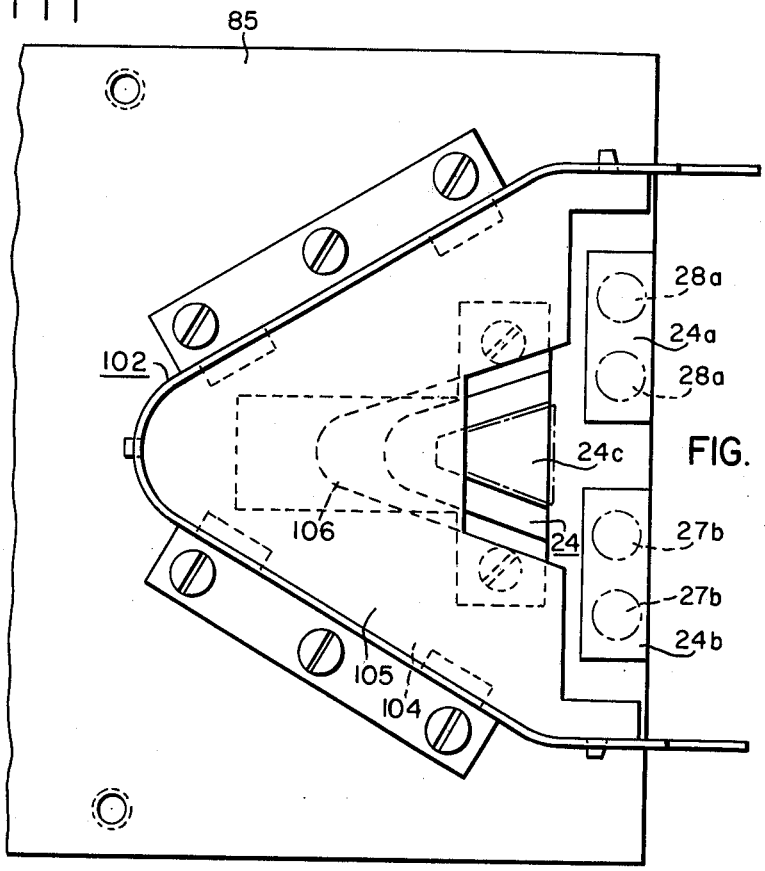

FIG. 20 illustrates the control circuit 81 for the solenoid 73, which is utilized to provide remote electrical tripping. As far as we are aware, it has not been able heretofore to provide a shunt trip feature 71 on a fuse switch. The shunt trip 71 allows the switch 10 to be opened from a remote location, either as required by an operator, or automatically when a certain condition occurs. One of the important uses for this feature is expected to be for protection against low ground fault current, for which fuses offer littler protection. A proposal has been made to revise the National Electric Code to require ground fault protection on circuits of 800 amperes and high capacity.

If reference is made to graphs on fuse-melting-time characteristics, it will be noted that a 1200 ampere fuse will allow a ground fault of 3000 amperes to persist for 1 minute, or more, and one of 1000 amperes to persist indefinitely.

Figure 19:
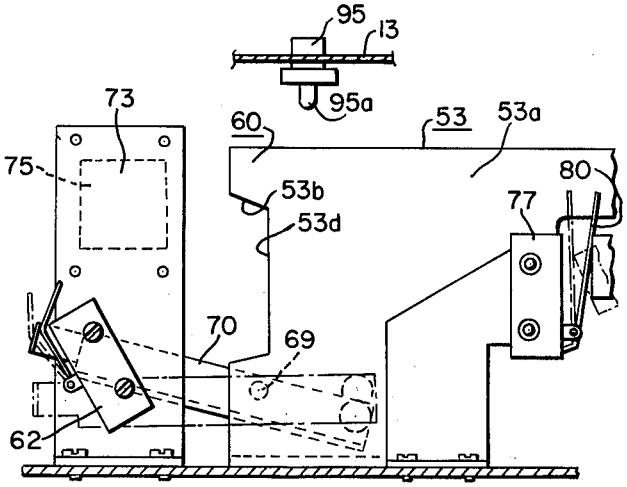
FIG. 19 is an enlarged fragmentary side elevational view of the tripping solenoid and cutout switch of FIG. 18, taken substantially along the line XIX—XIX of FIG. 18, the solid lines indicating the tripping position of the release lever.

FIG. 20 shows a typical wiring shceme 79, with all of the conductors being monitored passing through one current transformer 99, and the power for operation of the shunt-trip supplied by an external source 103. A 110 volt AC control circuit may be utilized in this connection. In series with the coil 75 of the solenoid 73 are the normally-open contacts 78 of a cut-out switch, designated by the reference numeral 77, and illustrated more clearly in FIGS. 2, 18, 19 and 20 of the drawings. Thus, when the switch 10 is open, the normally-open contacts 78 of the cut-out switch 77 are open, and energization of the control circuit 81 is ineffective. On the other hand, when the switch contacts 78 are closed, the interengagement between the insulating tie-bar 34 and the operating lever 80 of the cut-out switch 77 is removed (see FIG. 19), and the interlock switch contacts 78 are closed. This completes the circuit for remote tripping 81, as is obvious. Refer to patent application, Ser. No. 35,409, filed May 7, 1970 now U.S. Pat. No. 3,634,730 issued Jan. 11, 1972 to John T. Wilson in this connection.

The external handle 11 remains in the "ON" position when the switch is tripped remotely. A trip indicator 95 is mounted on the cover when desired. When the switch trips, the rotatable toggle support 65 strikes a plunger 95*a* in this indicator 95 moving it to an indicating position on the outside of the cover 13. The optional alarm switch 62 (FIG. 19) also operates only when the switch is tripped by engagement with the rotatable tripping lever 70.

It will be observed from a study of FIG. 2 of the drawings that each of the pole-units "A," "B" and "C" has its own fuse 82A, 82B and 82C. The fuses 82A, 82B and 82C may be of 1200 amperes, 600 volts A.C. for example. Thus, the fuses provide fault, or overcurrent protection for the switch.

By way of recapitulation, the three line connectors L1, L2 and L3, affixed to the three line contact plates 84, 85 and 86, pass the current through the stationary main and movable main contacts 24*a*, 24*b* and 25*a*, 25*b* to the shunt connectors 88 to the movable contact support plates 90, 91 and 92. As observed in FIG. 2, the moving contact support plates 90, 91 and 92 have extensions, constituting fuse-terminal plates 90*a*, 91*a* and 92*a*, which are secured by bolts 94 to the blades 96 of the fuses 82A, 82B and 82C. The current, consequently, passes through the fuses, and through the other fuse blades, which are bolted to the fuse contact bases, or terminals 100A, 100B and 100C. Situated at the right-hand ends of the three fuse contact bases 100A, 100B and 100C, as viewed in FIG. 2, are the load-terminal connectors $F_1$, $F_2$ and $F_3$, which may connect to the branch circuits controlled by the branch switches 3–9, as illustrated in FIG. 1.

ARC-CHUTE STRUCTURES (102)

Figure 9:
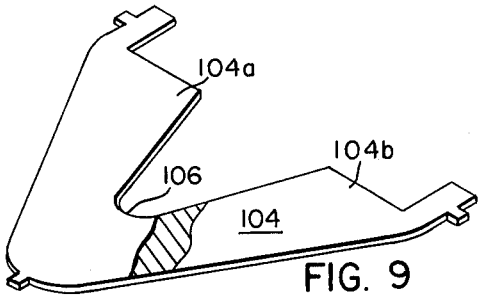
FIG. 9 illustrates one of several arcing metallic plates used in the arc-chute structure of the improved switch.
Figure 8:
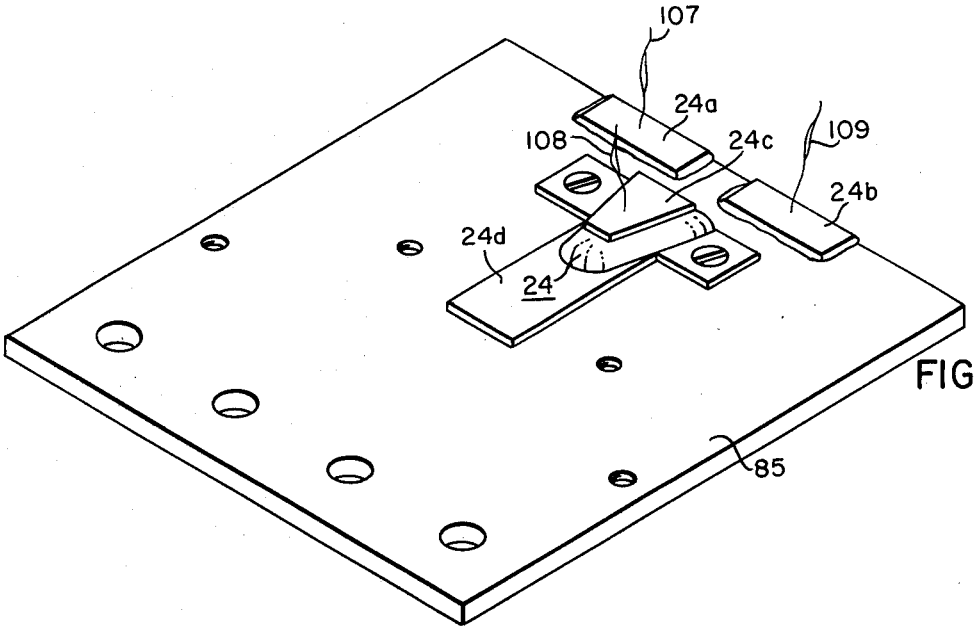
FIG. 8 is a perspective view of the stationary contact support plate, or terminal plate, together with the stationary arcing horn affixed thereto. The view also shows the stationary main contacts for the two pairs of movable main contacts.
Figure 7:
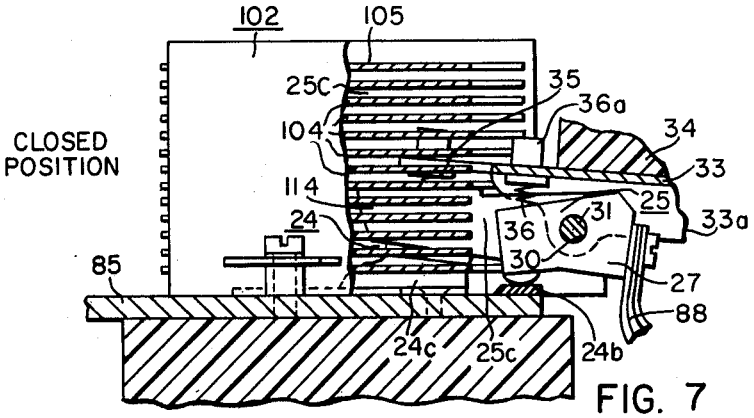
FIG. 7 illustrates, fragmentarily, a side elevational and partly sectional view through the arc-chute structure for the contact structure and the manner of arc interruption with the contacts shown in the closed position.
Figure 11:
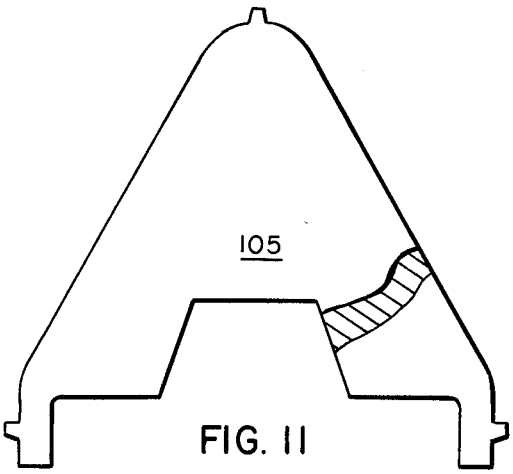
FIG. 11 illustrates, in plan, the top arcing, or cover plate of the arc-chute structure.

FIG. 7 illustrates, in more detail, the arc-chute structure 102, which are associated with each pair of separable switch contacts 24, 25. As previously mentioned, the stationary contact structure comprises stationary main contact plates 24*a*, 24*b* and an upwardly-protruding stationary arcing contact 24*c*, which overlies an arc-horn plate 24*d*. During the opening operation, arcing may take place between both the main contacts 24*a*, 24*b* and also the arcing contact 24*c*. The arc-chute structure 102 is adapted to accommodate arcing at both the separable arcing contacts and also the main contacts. The arc-chute structure 102, illustrated in FIG. 7, comprises a plurality of metallic plates of two types 104, 105, illustrated, respectively, in FIGS. 9 and 11, which closely adjoin the main separable contacts 24*a*, 24*b*, 25*a*, 25*b*. The apex 106 of the slotted portion of the magnetic plates 104 closely surrounds the extending tip 25*c* of the movable arcing contact 25*c* (FIG. 7). Thus, arcing is accommodated at both the main contacts and also at the arcing contacts. It is an established test fact that a plurality of shunting arcs 107, 108, (FIG. 9) may be established, both at the main contacts and also at the arcing contacts. The provision of the body portions, designated by the reference numeral 104*a*, 104*b* in FIG. 9, provides an entrance for the arcs 107, 109 established at the main contacts 24*a*, 24*b*. These arcs 107, 109 are split up into a plurality of serially related arcs between the plates 104, and are cooled and deionized until arc extinction ensues.

Figure 10:
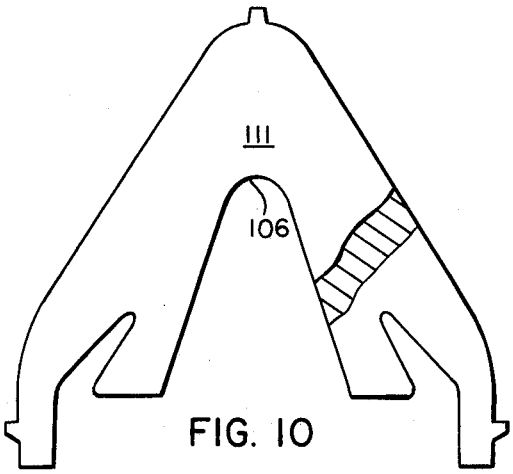
FIG. 10 illustrates an alternate type of metallic arcing plate, which may be used in substitution of the arcing plate of FIG. 9.
Figure 12:
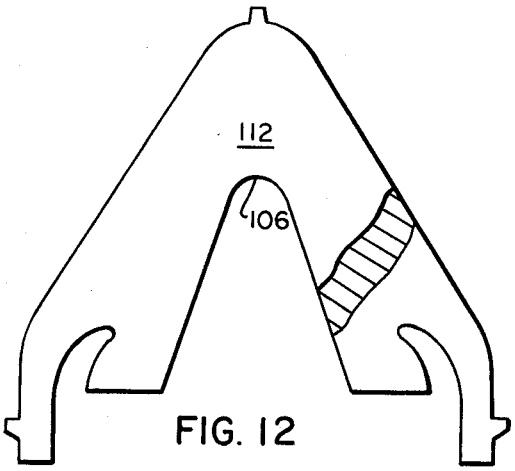
FIG. 12 is another alternate type of arcing plate, which may be used in substitution for the plates of FIGS. 9 and 10.

Alternate arcing plates 111, 112 such as illustrated in FIGS. 10 and 12, may be substituted for the arcing plates 104 of FIG. 9 in the lower portion of the arc-chute stack 102. This will facilitate the entrance of the arcs 107, 109 from the main contacts 24*a*, 24*b* into the plate structure. U.S. Pat. No. 3,749,867 claims the arc-chute construction.

From the foregoing description, it will be apparent that there has been provided an improved switch structure 10 and switch mechanism 22, which is of low vertical height, and positions the overcenter springs 46 away from the energized parts of the interrupter, and away from the handle mechanism 21. The toggle mechanism 22 results from the utilization of few parts having many functions. For example, the pin 61 not only serves as a support for the two side-frame walls 53, 54, but also as a stop for the open position of the switch contacts 24, 25. The rod 56, passing through the upper ends of the arms 50*a* of the angularly shaped members 50, serves not only as a support therebetween, but also as an actuating means for the reciprocal slide 19, which is operated by the external handle mechanism 21. In addition, the slots 49, provided at the outer ends of the arms 50*b* of the angularly shaped members 50, serve not only as pivot supports, for the rod 48 supporting the springs 46, but also serves a resetting function, as illustrated in FIG. 4. Also, the rotatable releasable toggle-pivot support 65 serves a number of functions. First, a portion 65*b* serves as an overcenter stop; another portion 65*c* serves 44*a* a resetting means to engage the spring rod 48. Also the knee-joint pivot 44 serves as a spring support 44a for the two toggle tension springs 46 to equalize the stresses and forces exerted upon the toggle mechanism 22.

Generally, the toggle mechanism 22 is easy to assemble. Each of the side plates 53, 54 may be secured to the base 115 of the switch by two mounting screws 116 (FIG. 4), after the several pivot pins and rods have been positioned into the apertures within the side plates 53, 54. Also, the rear ends of the side plates 53, 54 are configured to provide spaced stops 53*b*, 53*c*, 54*b*, 54*c* for the rotative travel of the spring-rod support 48. The recesses are designated by the reference numerals 53*d* and 54*d* in FIGS. 14 and 15 of the drawings.

As mentioned, the overcenter-toggle mechanism 22 of the instant application provides an accurate external indication of a welded condition at the contacts 24, 25.

From the foregoing description, it will be apparent that the switch 10 of the present invention makes many advances in the art. For example, the toggle mechanism 22 is electrically isolated from the circuit. In addition, the toggle mechanism is provided with springs 46, which are shifted away from the operating handle 11. Moreover, the switch depth is reduced, so that, for example, 1200 ampere switches are flush with all of the smaller feeder switches 3–9.

Preferably, longer toggle springs 46 are used in the present switch mechanism, and this, of course, means a less critical design of the springs 46. A very important feature of the improved switch of the present invention is that there is provided an excellent "positive on" function should welding occur. Also, there is provided a very good opening force on a tripping operation. An easily installed solenoid trip features may be readily provided as an optional feature with a trip indicator, as desired.

The improved toggle operated mechanism 22 of the present invention is such, that it may be operated only by the use of special effort, or special tools, when the cover 13 is opened. Also, the connectors for the switch are symmetrical, so that they can be used at either line or load end. The connectors and the switch are front mountable, if desired. Finally, the desired features for interlocking and padlocking have been retained in the improved switch construction 10 of the present invention.

Although there has been illustrated and described various embodiments of the invention, it is to be clearly understood that the same were merely for the purpose of illustration, and that changes and modifications may readily be made therein by those skilled in the art, without departing from the spirit and scope of the invention.

We claim as our invention:

1. An electrical switch comprising a relatively flat switch-box enclosure and a cooperating metallic hinged flat switch-cover hinged to one lateral side of the relatively flat switch-box enclosure, a rotatable manually operable operating handle rotatably mounted on the external outer side of the flat switch-cover, a slotted linearly movable operating slide secured to the inner side of the flat switch-cover and operatively connected with the outer-disposed manually operable operating handle, one or more electrical pole-units mounted internally of said relatively-flat switch-box enclosure upon the base portion thereof, each pole-unit having a relatively stationary contact and a cooperable movable contact, means defining an over-center toggle switch-operating mechanism mounted upon the base portion of the relatively flat switch-box enclosure and comprising a pair of upstanding, laterally spaced metallic support-plates extending substantially transversely of the flat switch-cover, a stop-pin extending across the upper forward ends of said two upstanding metallic support plates and collectively serving as a stop for the opening movement of said movable contact, a pair of cooperative "L"-shaped operating levers pivotally mounted upon aligned fixed pivots located near the base of the two upstanding metallic support plates and having a movable operating pin interconnecting the upper ends of two cooperating first legs of the "L"-shaped operating levers, said operating pin mating in cooperative relationship with said linearly movable slotted slide to be operated thereby in the opening and closing directions longitudinally of the respective pole-unit, means pivotally mounting the movable contact for opening and closing rotative action, said over-center toggle mechanism effecting actuation of said movable contact including a pair of interconnected toggle-links pivotally connected together at a knee-joint, means defining a rotatable releasable toggle-pivot support (65), said releasable toggle-pivot support (65) being rotatable about a fixed pivot located at the upper ends of the two upstanding metallic support plates and intermediate the length thereof, one end of one of the toggle-linds (37) being pivotally connected to the pivotally mounted movable contact, the other end of the other toggle-link (38) being pivotally connected to said releasable movable toggle-pivot support (65), a pair of toggle-tension springs connected at one end to said knee-pin and at the other end (49) thereof to the extremity of the other two cooperating second legs of the "L"-shaped operating levers, the operation of the external handle means effecting longitudinal motion of said operating pin to thereby effect over-center spring throw of said toggle links for opening and closing action of the separable contacts, a portion of said releasable toggle-pivot support (65) serving as an over-center abutment for said knee-pin in the open-circuit position of the switch, means for releasing said releasable toggle-pivot support to open the separable contacts, said toggle-pivot support (65) having a downwardly directed resetting tail portion which makes resetting abutment with the said second operating pin carried by the outer extremities of said second cooperating legs of the "L"-shaped operating levers to thereby effect resetting the toggle-pivot support (65), latching means for releasably latching the releasable toggle-pivot support (65), and tripping means for releasing said latching means for thereby effecting the release of the toggle-pivot support (65) to effect thereby tripping opening operation of the separable contacts, the location of the knee-pin in the closed-circuit position of the switch being substantially lateral of a straight line interconnecting the fixed pivots for the "L"-shaped operating levers and said second-mentioned pin, whereby during a closed welding position of the separable contacts, the pair of toggle-tension springs will exert a strong biasing action to bias the operating pin and hence the slide to a "closed" indicating position as reflected visually on the outer manually-operable handle.

2. Switch means including a pair of separable contacts seperable to establish arcing, an operating mechanism of the over-center toggle-type for effecting opening and closing movements of said separable contacts, said operating mechanism comprising a pair of upstanding laterally spaced-apart metallic support plates, a pair of laterally spaced-apart cooperable "L"-shaped operating levers having a fixed pivot axis generally forward of said support plates and additionally generally located halfway between the upper sides and the lower sides thereof, said "L"-shaped operating levers each having cooperable first legs and second legs, toggle linkage comprising a pair of pivotally connected toggle-links, one end of one of the toggle links being pivotally connected to the movable switch contact arm, the other end of the other toggle-link being pivotally connected to a rotatable releasable toggle-pivot support (65), said toggle-pivot support (65) being located halfway between said pair of upstanding laterally spaced metallic support plates and having a pivot-axis located adjacent the upper sides of the support plates and intermediate the longitudinal ends thereof, manual-operating means for effecting rotation of the first spaced legs of said pair of "L"-shaped operating members, a pair of toggle-tension springs disposed on opposite sides of said releasable toggle-pivot support (65) and connected between the knee-joint of the toggle linkage and the extremity of the other two second legs of the "L"-shaped operating levers, the location of the knee-joint in the closed position of the switch, when the toggle linkage is straightened, being such as to considerably reduce the tensile force exerted by the two toggle-springs in the closed-circuit position of the device when the toggle-linkage is straightened, as opposed to the tensile force of the two tension toggle-springs in the open-circuit position of the device, said rotatable releasable toggle-pivot support (65) being a plate-like member having one portion thereof serving as an over-center stop for the toggle linkage in its extended "in-toggle" position, said releasable toggle-pivot support (65) having a tail portion extending toward the rear portion of the two upstanding support plates, an operating rod supported at the extremities of the other second legs of the "L"-shaped operating lever, and making abutment with said tail portion of the releasable toggle-pivot support (65) during a resetting operation of said toggle-pivot support (65), latch means for latching said toggle-pivot support (65) in its reset condition, said plate-like toggle-pivot support (65) having a latching portion provided on its lower side for cooperable latching engagement with said latching means, whereby during a welded closed condition of the switch contacts with the toggle linkage extended, the considerably greater tensile force exerted by the toggle springs in the closing position will concomitantly effect a "closed" position indicating condition of the "L"-shaped operating lever for the safety of maintenance personnel, and whereby an effort being made by maintenance personnel to force the toggle linkage to the "open" position will nevertheless be overriden by the aforesaid strong tensile force causing thereby a return of the toggle springs to a reduced length with less tensile force in the "on" position of the "L"-shaped operating lever.

3. In a multiple-pole electrical switch of the type being enclosed in a metallic relatively flat enclosure having a base portion and having an externally operable rotatable manually operable handle movable to "on" and "off" positions, the combination therewith of a slotted slide-member mounted on the inner side of the said hinged cover and operable to effect operation of a switch mechanism, said switch mechanism comprising a pair of laterally spaced upstanding metallic support plates mounted upon the base portion of the relatively flat box enclosure, a pair of laterally spaced "L"-shaped operating arms, each of which is pivotally stationarily mounted upon a pivot pin located halfway up the upstanding support plates and toward the front portion thereof, an operating pin interconnecting the extremities of one pair of "first" legs of said "L"-shaped operating lever and engageable with the slot provided in the aforementioned slotted slide member, said operating mechanism further comprising an over-center toggle linkage having a pair of toggle-links pivotally connected together at a knee-pin, one end of one of the pair of toggle links being pivotally connected to the movable switch-arm to cause the opening and closing operations thereof, the other end of the toggle links being pivotally connected to a releasable toggle-pivot support, said toggle-pivot support (65) being pivotally mounted about a fixed pivot, said fixed pivot being located at the upper end of the upstanding support plates intermediate the longitudinal ends thereof, said releasable toggle-pivot support (65) being of plate-like configuration and having a movable pivot-support for the other end of said pair of toggle links, said plate-like toggle-pivot support (65) having a tail resetting portion, an operating pin supporting a pair of over-center toggle springs and interconnecting the extremities of the other "second" legs of said "L"-shaped operating lever and engageable with said tail portion of the releasable toggle-pivot support to effect a resetting operation thereof, latching means for releasably latching said plate-like toggle-pivot support (65), the other ends of the pair of toggle springs being pivotally connected to the knee-pivot pin of the toggle links for over-center toggle-spring action, the center locations of the stationary pivot for the "L"-shaped operating lever and the releasable pivot location afforded by the releasable toggle-pivot support (65) being such as to effect considerably more tension by the two toggle springs in the "open" circuit position than in the "closed" circuit position, whereby upon a welding closed condition occurring at the separable contacts, the difference in spring tension between the "open" and "closed" circuit positions is such as to constantly bias the "L"-shaped operating levers in a closed-circuit indicating position with considerable spring tension, whereby further, the efforts of maintenance personnel to maintain the operating lever in the open-circuit position are of no avail due to the aforesaid difference in spring tension in the "open" and "closed" circuit positions, whereby a correct indicating position of the externally-rotatable handle is obtained during such a welding closed condition of the contacts for safety of operating maintenance personnel.

* * * * *